US005711054A

United States Patent [19]

Salice

[11] Patent Number: 5,711,054

[45] Date of Patent: Jan. 27, 1998

[54] FITTING PART OR THE LIKE, MORE PARTICULARLY A HINGE PART WITH AN ATTACHMENT DEVICE

[75] Inventor: Luciano Salice, Carimate, Italy

[73] Assignee: Arturo Salice S.p.A., Novedrate, Italy

[21] Appl. No.: 545,495

[22] Filed: Oct. 19, 1995

[30] Foreign Application Priority Data

Oct. 19, 1994 [DE] Germany ..... P 44 37 470.4

[51] Int. Cl.[6] ..... E05D 5/00

[52] U.S. Cl. ..... 16/382; 16/383

[58] Field of Search ..... 16/383, 382, 384, 16/272, 261, 388, 387, 264, DIG. 40, DIG. 43

[56] References Cited

U.S. PATENT DOCUMENTS

| | | | |
|---|---|---|---|
| 2,798,404 | 7/1957 | Schaefer . | |
| 4,021,881 | 5/1977 | Lautenschlager | 16/383 |
| 4,088,355 | 5/1978 | Dey . | |
| 4,361,931 | 12/1982 | Schnelle et al. | 16/383 |
| 4,622,716 | 11/1986 | Lautenschlager | 16/384 |
| 5,345,654 | 9/1994 | Ferrari et al. | 16/272 |

FOREIGN PATENT DOCUMENTS

| | | |
|---|---|---|
| 2 502 675 | 10/1982 | France . |
| 2 231 328 | 1/1974 | Germany . |
| 22 31 328 | 1/1974 | Germany . |
| 2231328 | 1/1974 | Germany . |

*Primary Examiner*—Chuck Mah

*Attorney, Agent, or Firm*—Jacobson, Price, Holman & Stern, PLLC

[57] ABSTRACT

A fitting part comprises a bushing adapted to be inserted into a pre-drilled hole in a supporting wall and secured in such a manner as to prevent relative rotation on the bottom side of a plate-like part, a holding pin mounted in a rotatable manner in the bushing and which after rotation thereof is adapted to engage the wall of the hole directly or by the intermediary of locking clamping parts, and whose widened out head is engaged with the top side of the attachment flange, and a flat actuating part connected with the head in a pivotal fashion, which actuating part may be folded over out of an inactive position essentially parallel to the attachment flange into an actuating position essentially parallel to the axis of the holding pin. The fitting part can be consequently fitted in place in a simple fashion without special tools.

20 Claims, 4 Drawing Sheets

FITTING PART OR THE LIKE, MORE PARTICULARLY A HINGE PART WITH AN ATTACHMENT DEVICE

The invention relates to a fitting part or the like and more particularly a hinge part with an attachment device.

The prior German patent application P 44 24 151.8, which has not been prior published, discloses an attachment for a fitting part provided with an attachment hole and more especially for a hinge part, which comprises a bushing adapted to be inserted into a pre-drilled hole and in whose axially extending, through hole a pin is rotatably mounted which extends through the attachment hole and is provided with a head, the through hole being arranged eccentrically in the bushing or an annular insert part and the pin is provided with an eccentric shank part extending past the hole, on which shank part a clamping part is secured. In the case of this known attachment device the head is provided with a slot or with crossing slots for the application of a screw driver so that fitting is only possible with the aid of a tool.

The German patent publication 2,231,328 B discloses an assembly plate for furniture hinges having at least one attachment pin adapted to be inserted into a round hole in a wall of a piece of furniture and which possesses an eccentric part biting into the wall of the hole after being turningly inserted into the wall and which is provided with a holding plate extending in parallelism to the assembly plate and constituting a lever, which may be turned using an attachment pin between its released position and an engaged position. The angle of pivot of such holding plate is limited on the assembly plate by abutments so that the same serves for limiting the pivot angle. In order to be able to turn the holding plate it is, on the side opposite to the attachment pin, provided with a slot for engagement by a screw driver, it however appearing doubtful whether the attachment plate could be turned without any screw driver and only by hand out of the position for assembly into the mounted locking position.

One object of the invention is to create a fitting part of the type initially mentioned which may be fitted in place simply and without any special tools.

The holding pin of the fitting part in accordance with the invention is provided with an actuating part which is connected in such a manner as to prevent relative rotation with the upper shank part or head thereof or is otherwise connected with the same so as to be able to pivot about a radial pivot axis so that the actuating part, after being pivoted upward the actuating part may be simply and easily turned by hand for the purpose of being turned into the mounted or into the released setting. After turning the holding pin using the actuating part into its released setting, it is possible for the actuating part to be pivoted back into a plane parallel to the attachment flange or to the plate, which is to be attached with the result that it does not stick out and create an undesired impression.

The fitting part in accordance with the invention may for example comprise firstly a bushing adapted to be fitted in a pre-drilled hole and secured in such a manner as to prevent relative rotation to the lower-side of an attachment flange or of a plate-like part of the fitting part, such bushing being provided with a hole which is generally aligned with an opening in the attachment flange, secondly holding pin, whose widened out head is placed on the top side of the attachment flange and whose shank part adjoining the head extends through the opening, is rotatably mounted in the hole in the bushing and bears an eccentric part lockingly engaging the wall of the hole, and thirdly a flat actuating part, pivotally connected with the head, such actuating part being able to be turned over from an inactive position essentially parallel to the attachment flange into an actuating position essentially parallel to the axis of the holding pin.

Preferably the actuating part comprises a disk with a recess between fork-like limbs, at whose ends there are pins which are directed rectangularly inward and are pivotally mounted in radial holes or recesses adjacent to the head of the holding pin.

An other advantageous, particularly preferred feature of the invention is such that when the shank part of the holding pin is received in the bushing, with the top side of the attachment flange the recesses form slot-like guides for the pins and the limbs are provided on their top side with flat and lateral widened parts of the head, following the initial part of the slot-like guide, are provided on their bottom side with a corresponding flat so that for arresting it in a position folded onto the attachment flange the flattened parts of the limbs of the disk may be moved underneath the flattened acting of the head. In the case of this design the actuating part may be so secured both prior to assembly as also after assembly to the holding pin or, respectively, the head thereof that it can not be unintentionally moved into an upright position. Should it be desired to shift the actuating part into an upright position for the purpose of turning the holding pin, it is firstly necessary for the same to be moved in a radial direction out of its arrested position in parallelism to the attachment flange, before it can be moved into the upright position.

In order to be able to mount the actuating part simply in such a manner that the pins thereof fit into the recesses, it is possible for the recesses in the head to run out freely toward shank of the holding pin. It is in this manner that the pins may be simply inserted into the recesses by pushing the same from below in parallelism to the shank into the recesses. Such an assembly is more particularly possible because the slots holding the pins are formed between the top end of the recess and the outer side of the attachment flange, through which the holding pin extends.

In order to simply move the disk out of its arrested position into a position, in which same may be moved into an upright position, the disk can be provided on its top side with a notch to be engage by the user's finger nail.

In keeping with yet another possible form of the invention on its a side, in which the disk is folded over into the locking position, the attachment flange is provided with a ramp rising obliquely outward, which in the inserted position of the disk is covered over by a recess provided on its bottom side. If the disk is drawn radially outward from its arrested position, a wall surface of the disk's recess will run over the obliquely rising ramp with the result that it can be readily pivoted out of its position parallel to the attachment flange upward and consequently may be more readily gripped for moving it into a completely erected or upright setting.

The disk may be provided on its bottom side with lateral tooth-like projections, which, in the folded over and inserted position turned into the locking position, fit into corresponding recesses in the attachment flange. These tooth-like projections having obliquely upwardly ascending flanges as well serve to facilitate movement of the disk into an upright position or out of its prepared assembly position.

The disk may possess a rectangular configuration.

It is convenient if the head is generally in the form of a letter T, the middle bar thereof corresponding in size to the width of the recess between the limbs of the disk so that when the disk is pivoted into the plane thereof and is inserted the head adjoins it to give a part with a continuous surface. The head and the turned over and inserted disk may, taken together, constitute a rectangular form to give a pleasing, harmonious overall structure.

It is preferred for the end surfaces of the limbs of the disk to bear with friction, in the actuating position, on the attachment flange. In this manner it is possible to ensure that the disk can not be unintentionally turned over after moving it into an upright setting for the purpose of turning the holding pin.

In accordance with a still further development of the invention the head has a radial tail placed in a drawn in part of the attachment flange or of the plate to be attached and parts of the peripheral wall of the drawn in part constitute notches for the flanks of the tail so that the holding pin may only be turned between its released and its locked position. It is convenient if the holding pin is turned through 180° between its released and its locked position so that the abutments only permit such turning.

The invention furthermore contemplates the provision of the shank of the holding pin with an external eccentric shank part, on which a disk is held having at least one peripheral cutting or self-tapping edge. Furthermore the shank may be rotatably mounted in an eccentric hole in the bushing, such two eccentricities being so matched to each other that the disk or the like is in alignment with the bushing in the assembly position and in its position turned through 180° is moved radially outward by an amount equal to the two eccentricities.

It is convenient if the bushing is provided at its top end with at least one top projection, which acting as a means preventing mutual rotation fits in a corresponding recess in the attachment flange.

In accordance with a preferred development of the invention the holding pin extending through the attachment flange, the bushing and the disk is provided with a rivet head holding the disk. It is in this manner that the attachment flange or the plate to be attached may be permanently and inseparably joined to the attachment device.

In keeping with yet another possible form of the invention, there is a provision such that the head of the holding pin, instead of being provided with a folding actuating part, is provided with a slot turning it using a simple tool, as for example a coin.

Working embodiments of the invention will now be described with reference to the accompanying drawings in detail.

Figure 1:
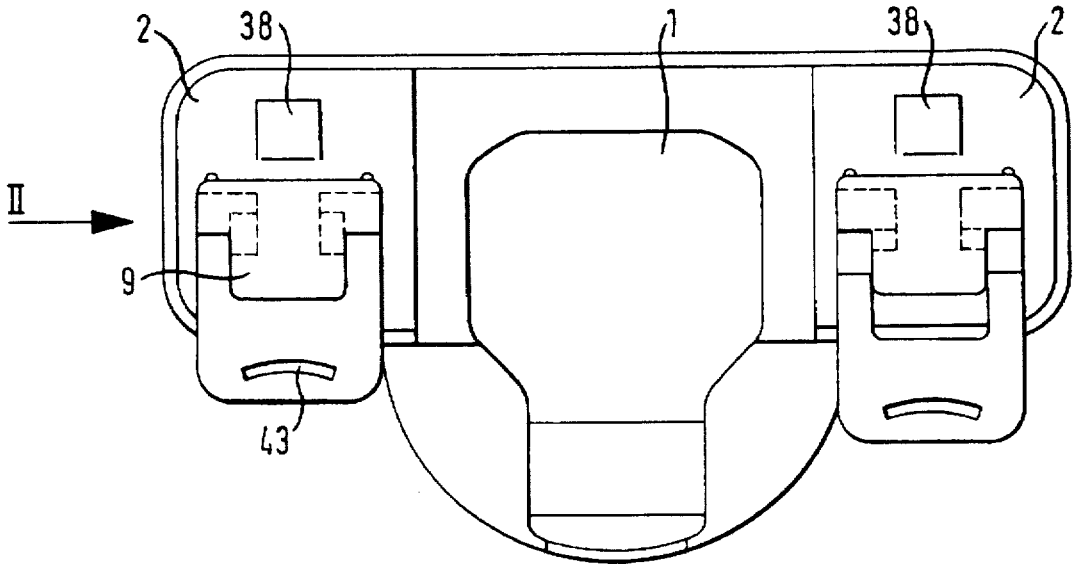
FIG. 1 shows a plan view of a hinge pot, provided with an attachment flange, having the attachment device in accordance with the invention.

FIG. 1 shows a conventional hinge pot 1 with lateral attachment flanges 2, which constitutes the moving hinge part of a double link hinge. For the attachment of the hinge pot 1 use is made of an attachment device 3, which is best to be seen in FIG. 7.

Figure 9:
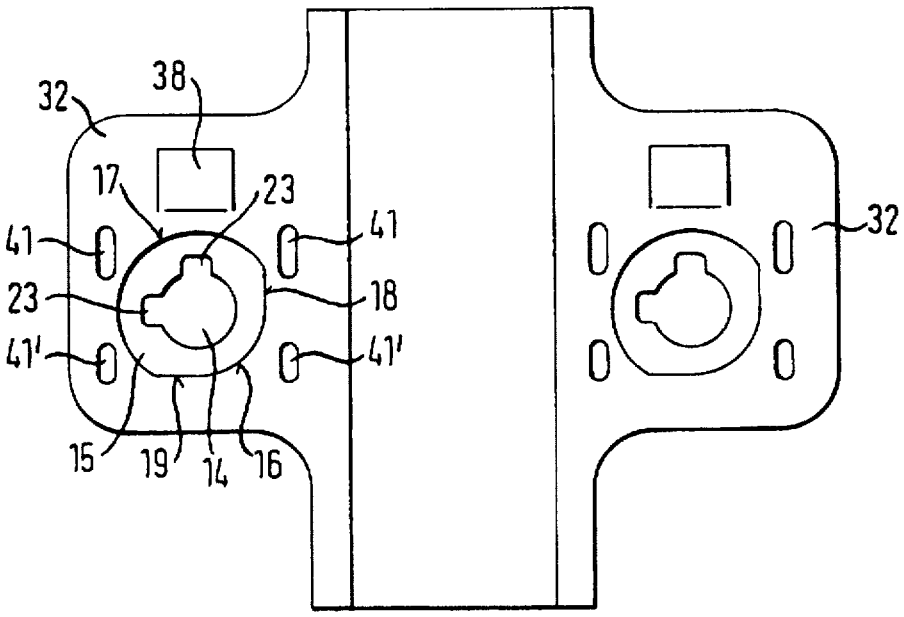
FIG. 9 is a plan view of a hinge attachment plate to be secured using the attachment device in accordance with the invention.
Figure 10:
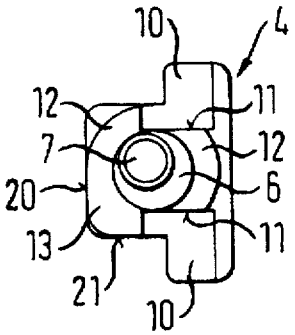
FIG. 10 is view from below of the holding pin.

The attachment device 3 comprises a holding pin 4, which possesses a specially formed head part 5 and a cylindrical shank part 6 adjoining same, such shank part being continued as a cylindrical eccentric shank part 7 of lesser diameter. The head part 5 is, as seen in plan view, generally T-like and has a squat, wide middle bar 9, which is best to be seen in FIG. 1. On its bottom side the head part 5 is provided with lateral recesses 10 which in the manner best seen in FIG. 10 are located underneath the lateral bars and the middle bar 9, the inner walls 11, which are parallel to one another, of the recesses 10 merge tangentially with the head part 6. Underneath the T bar 9 the head part 5 is provided with an annular part 12, which is interrupted by the recesses 10 and possesses a radial spur-like concave part 13. The shank 6 of the holding pin 3 extends through an opening 14 in the flange-like part 2 and 32, the head-like part 5 bearing against the floor of a drawn in part 15, whose form is best to be seen from FIG. 9. The drawn in part 15 possesses two mutually opposite concentric wall parts 16 and 17 which different radiuses of curvature, the wall parts 16 and 17 being connected together by wall parts constituted by straight flanks 18 and 19, such wall part adjoining the wall part 16 tangentially with a lesser radius of curvature. The straight wall parts 18 and 19 constitute the abutments, limiting the pivot angle of the holding pin 3, for the flanks 20 and 21 of the radial tail 13.

The opening 14 in the flange-like parts 2 and 32 is provided with radial recesses 23, into which the pin-like projections 26, provided at the top end of the bushing 25 fit so that the bushing 25, in its fitted state, is held on the bottom side of the attachment flanges without being able to be turned. The bushing 14 is provided with an eccentric hole 27, which is aligned with the opening 14 in the flange-like parts. The bushing 25 preferably consists of plastic. The holding pin has a shank part 6 extending through the hole 27 in the bushing 25, the disk, which is provided with a through hole, being slipped over the eccentric shank part 7. The disk 28 is provided with two self-tapping helical screw thread turns 29. The eccentric shank part 7 is, after the fitting in place of the disk 28, provided with a bottom rivet head 30 so that the holding pin whose shank part 6 extends through the holes 14 and 27 and the shank part 7 extends through the hole in the disk 28 is locked axially while being able to turn through approximately 180° on the attachment flange 2 and 32.

In the recesses 10 inwardly directed pins 33 are held so that same may move longitudinally, such pins being bent at an angle from the lateral limbs 34 of a generally rectangular actuating plate 35 having rounded corners. The pins 33 are slipped over the shank 6 into the recess 10, before for assembly the holding pin 3 is pushed through the holes in the flange, in the bushing and in the disk 28 and the unit is riveted together with the result that the pins fit into slot-like guides, which are formed between the top wall of the recesses 10 and the top side of the attachment flanges 2 and 32 following fitting in position of the attachment pin 3. The limbs 34 of the actuating plate 35 are, as indicated in FIG. 7, provided with flats 36 at their free ends, which flats connect via steps 37 with the thicker part of the attachment plate.

Figure 7:
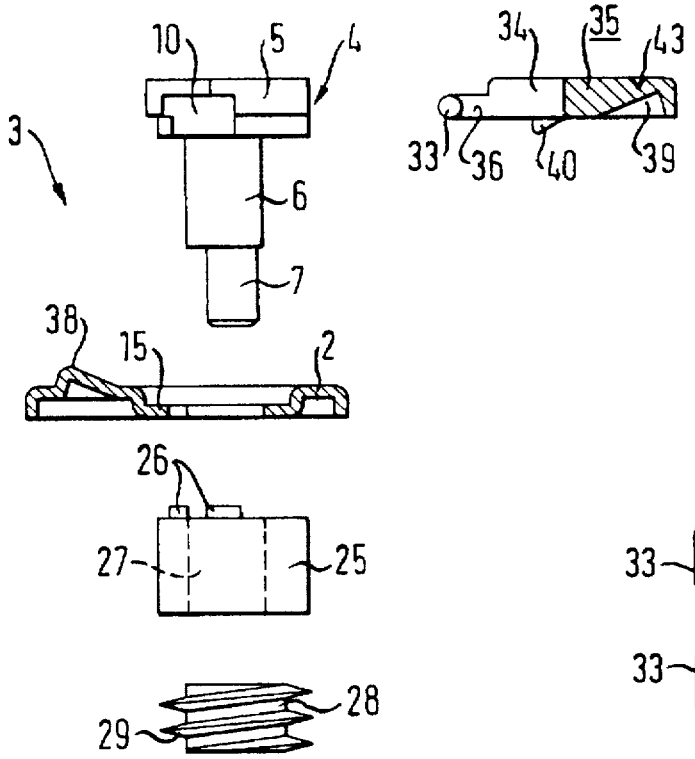
FIG. 7 shows a side view of the attachment device in the drawn apart condition of its individual parts, partly in section.
Figure 8:
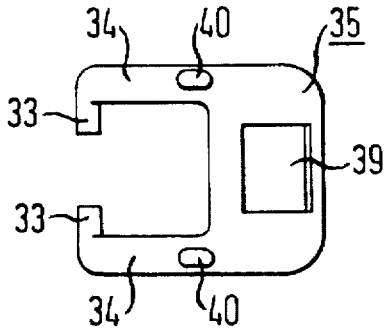
FIG. 8 is a view from below of the actuating part.

On the sides, in which the attachment plates 35 are folded in the locking position of the attachment device onto the attachment flanges, the attachment flanges 2 and 32 are provided with ramp-like humps 38, which, as best depicted in FIG. 7, rise outward like wedges. The actuating plate 35 is on its bottom side provided with a recess 39 which is generally complementary to the ramp-like hump 38 with the result that the ramp-like hump 38 may assume a position in the recess 39 in the locking position indicated in FIG. 5, when the terminal parts provided with recesses 36 are thrust underneath recesses 10 of the head part and the attachment plate 35 is located in its arrested setting in parallelism with the attachment flange.

Figure 5:
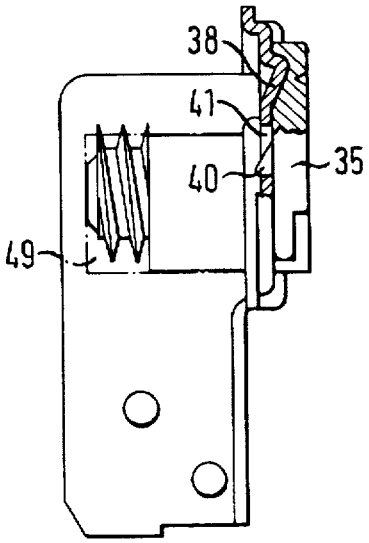
FIG. 5 is a partly sectioned lateral elevation showing the hinge pot looking in the direction of the arrow V in FIG. 4.

The limbs 34 of the actuating plate 35 are on their bottom side furthermore provided with saw-tooth projections 40, which in the locking setting depicted in FIG. 5 (wherein the attachment plates as well are located in their arrested position) fit into corresponding recesses 41 in the attachment flanges.

Figure 4:
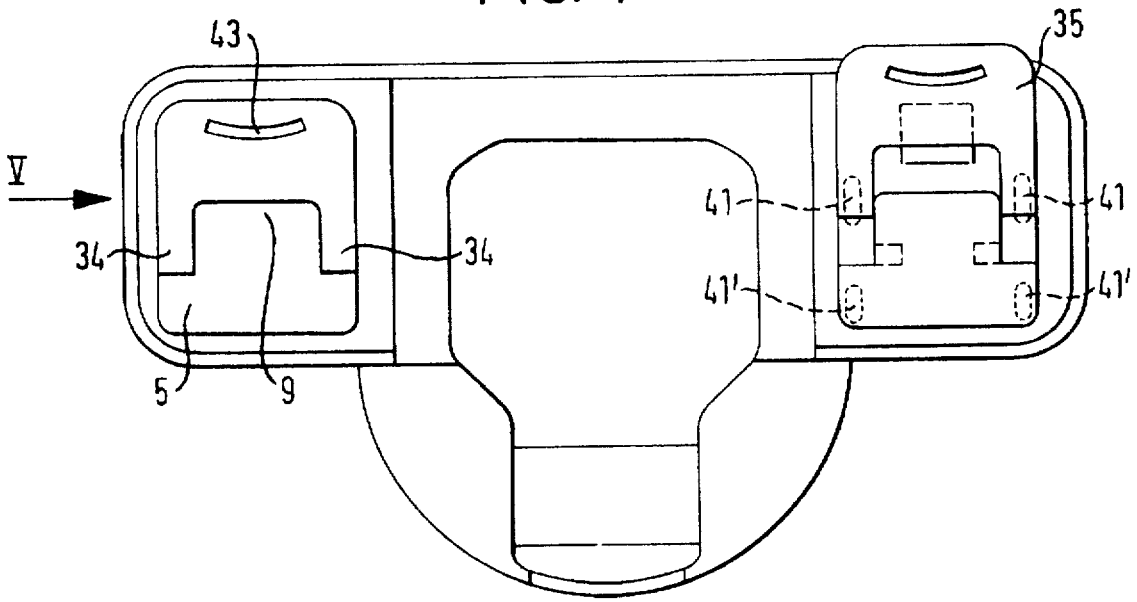
FIG. 4 is a plan view corresponding to FIG. 1 to show the hinge pot in a position, in which its attachment pins are located in their locking position.
Figure 6:
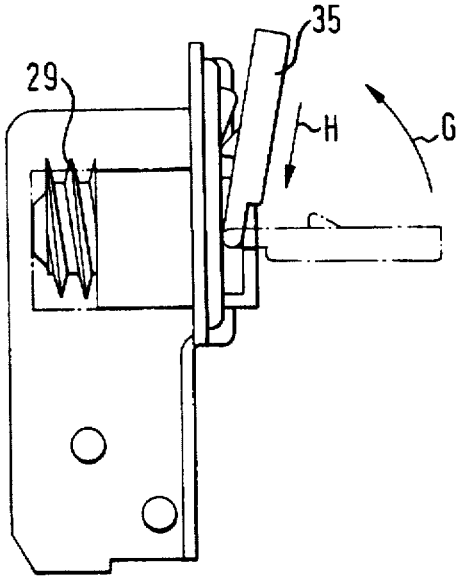
FIG. 6 is a lateral view corresponding to FIG. 5 to show the hinge pot with the attachment acting in its radially drawn out position to be seen on the right in FIG. 4.

On its top side the actuating plate 35 is provided with a curved notch 43, into which a finger nail may be inserted in order to move the actuating plate out of its left hand arrested, locking position illustrated in FIGS. 4 and 5 on the left into its radially drawn out setting illustrated on the right in FIGS. 4 and 6, wherein the actuating plate 35 may be turned through approximately 90° into its actuating position as in shown in broken lines in FIG. 6, in which owing to engagement on the actuating plate 35 the holding pin of the attachment device may be turned in the desired fashion between its locking and its released settings.

As best depicted in FIGS. 5 and 6, owing to the radial retraction of the attachment plate 35 from the position indicated in FIG. 5 into the position illustrated in FIG. 6 such plate 35 may be readily lifted out of its position in parallelism to the attachment flange so that it may be now readily grasped between the fingers.

Figure 2:
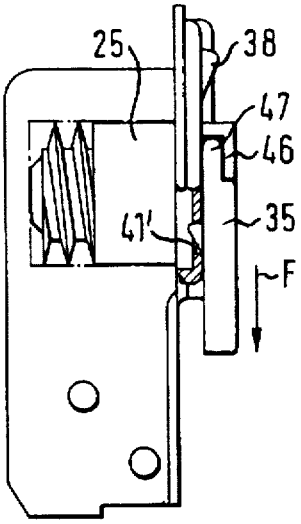
FIG. 2 is a lateral elevation of the hinge pot looking in the direction of the arrow II in FIG. 1.
Figure 3:
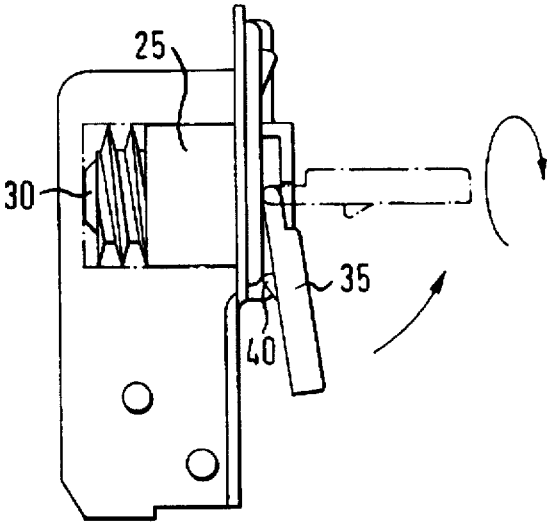
FIG. 3 is a lateral elevation corresponding to FIG. 2 of the hinge pot actuating part with the actuating part in its radially drawn out position to be seen on the right in FIG. 1.

The attachment device in accordance with the invention is supplied in its position illustrated in FIGS. 1 and 2 on the left ready for fitting. In such position the attachment plate is in its radially inwardly inserted position parallel to the attachment flange 2, in which the cover part 46 of the recess 10 of the head-like part 5 fits around the front part 47, made thinner by the recess 36, of the limbs 34. In the position ready for fitting indicated in FIG. 2, the rear end of the actuating plate 35 extends past the edge of the attachment flange 2. If now the actuating plate 35 is moved in the direction of the arrow F radially outward, the actuating plate will move somewhat toward an upright position as indicated in FIG. 3, because the saw-tooth projections 40 bear against the edge of the opening 41' and accordingly pivot the actuating plate 35 somewhat. Once the actuating plate 35 is moved into the upright setting as indicated in broken lines in FIG. 3, it is possible for the holding pin to be rotated into its fitted position indicated in FIGS. 5 and 6 by turning the attachment plate 35 in the direction of the curved arrow out of its assembly position indicated in FIGS. 2 and 3 into its fitted position as shown in FIGS. 5 and 6. In this position the self-tapping or cutting screw thread 29 on the disk 28 bites into the lateral sidewall of the attachment hole 49, as indicated in broken lines. Owing to the helical arrangement of the self-tapping screw thread 29 the attachment device is additionally drawn into the pre-drilled hole 49.

In the fitted state the actuating plate is then folded over in the direction Of the arrow G in FIG. 6 onto the attachment flange and then moved inward in the direction of the arrow H with the result that the attachment plate passes into its arrested position in which it is fitted as indicated in FIG. 5. In this position the limbs 34 of the wide T bar 9 of the head part 5 fit into position in the fashion indicated on the left hand side of FIG. 4 so that the actuating plate 35 gives a pleasing, harmonious overall structure of the fitting.

A further embodiment of the attachment device in accordance with the invention is to be seen in FIGS. 11 through 14. In the case of this working embodiment the shank part 6 and the shank part 7, eccentrically continuing the latter, of the holding pin 50 possess the same configuration as in the embodiment of the invention illustrated in FIG. 7 so that attention may be directed to this first embodiment.

Figure 11:
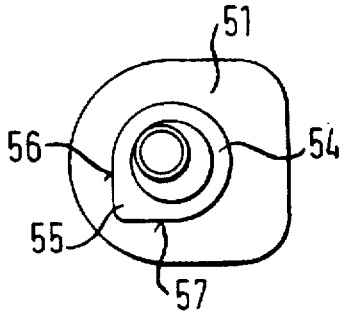
FIG. 11 is a view from beneath of a second working embodiment of a holding pin.
Figure 12:
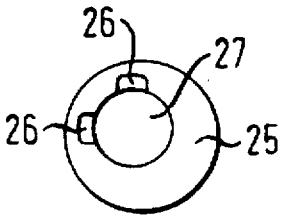
FIG. 12 is a plan view of the bushing.
Figure 13:
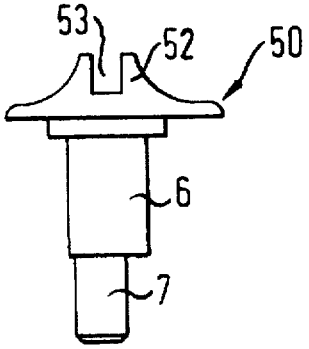
FIG. 13 is a lateral elevation of the attachment pin in accordance with FIG. 11.
Figure 14:
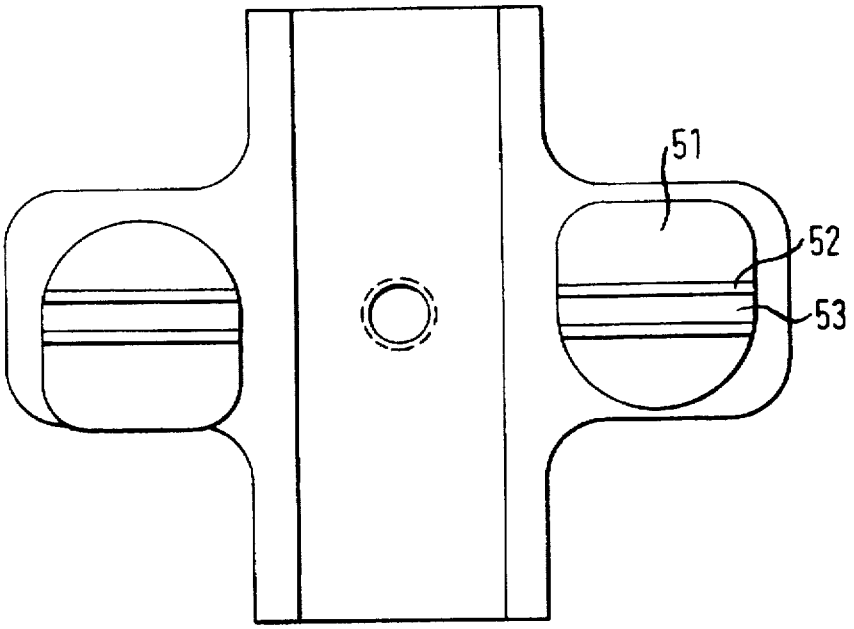
FIG. 14 is a plan view of an attachment plate to be attached with the holding pin in accordance with FIGS. 11 and 13.

The head of the holding pin 50 is designed in the form of a widened plate 51 with the geometry indicated in FIGS. 11 and 14, a transversely extending hump 52 being provided on the top side of the head 51, such hump being designed with a slot 53 into which a screw driver or a coin can be inserted.

Underneath the head 52 an annular ledge 54 is provided having a radial recess 55, whose lateral flanks 56 and 57 constitute abutments for the counter-abutments formed by the wall parts 18 and 19 of the drawn in part 15.

I claim:

1. A fitting part having an attachment device for attaching the fitting part to a supporting wall, the attachment device comprising a bushing adapted to be inserted into a predrilled hole in the supporting wall and secured thereto, a holding pin mounted in a rotatable manner in the bushing, and which after rotation thereof, the holding pin engages the wall of the hole, the holding pin defining a longitudinal axis extending in a direction perpendicular to a direction of rotation of the holding pin, a head of the holding pin engaged with a top side of an attachment flange section of the fitting part, and a flat actuating part connected with the head in a pivotal fashion, the actuating part being foldable over the attachment flange into an actuating position extending essentially parallel to the longitudinal axis of the holding pin.

2. The fitting part as claimed in claim 1, wherein the actuating part comprises a disk with a recess surrounded by fork-like limbs having inwardly directed pins located at the ends of said fork-like limbs, the pins being pivotally mounted in recesses defined in the head of the holding pin.

3. The fitting part as claimed in claim 2, wherein a shank part of the holding pin is mounted in the bushing with the recesses cooperating with the top side of the attachment flange in forming slot-like guides for the pins with the result that the disk may be pushed along underneath the head for arresting the disk in a folded over position onto the attachment flange.

4. The fitting part as claimed in claim 3, wherein the recesses in head extend toward the shank of the holding pin.

5. The fitting part as claimed in claim 2, wherein the disk is provided with a notch for engagement by a finger nail.

6. The fitting part as claimed in claim 2, wherein the attachment flange is provided with an obliquely outwardly rising ramp, which in an inserted position of the disk is covered over by a recess of the disk.

7. The fitting part as claimed in claim 2, wherein the disk is provided with lateral tooth-like projections fitting into corresponding recesses in the attachment flange in a locking, folded downward and inserted position.

8. The fitting part as claimed in claim 2, wherein the disk possess a generally rectangular form.

9. The fitting part as claimed in claim 2, wherein the head of the holding pin is generally T-like in form and a middle bar thereof is equal in size to a width of a recess between the limbs of the disk.

10. The fitting part as claimed in claim 2, wherein terminal surfaces of the limbs of the disk bear with friction against the actuating flange in the actuating position thereof.

11. The fitting part as claimed in claim 2, wherein the holding pin extends through the attachment flange, the bushing and the disk, and is provided with a rivet head holding the disk.

12. The fitting part as claimed in claim 1, wherein the head possesses a radial tail located in a drawn in part of the attachment flange and, parts of a peripheral wall of the drawn in parts form abutments for flanks of the tail so that the holding pin may only be turned between released and locked positions.

13. The fitting part as claimed in claim 1, wherein a shank of the holding pin bears an external shank part, on which a disk with at least one peripheral cutting edge is held.

14. The fitting part as claimed in claim 1, wherein a shank is rotatably mounted in an eccentric hole in the bushing.

15. The fitting part as claimed in claim 1, wherein a top end of the bushing is provided with at least one top projection, which fits into a corresponding recess in the attachment flange to prevent relative rotation.

16. A fitting part comprising an attachment device for attaching the fitting part to a supporting wall, the attachment device comprising a bushing adapted to be inserted into a pre-drilled hole in said supporting wall and secured on a first side of an attachment flange section of the fitting part in a non-rotatable manner relative thereto, a holding pin including a shank part and a widened head mounted in a rotatable manner in the bushing, and which after rotation thereof, the holding pin engages a wall-portion of the hole, the widened head of the holding pin resting on a second side of the attachment flange section, and the holding pin defining a longitudinal axis extending in a direction perpendicular to a direction of rotation of the holding pin, a flat actuating part connected with the head of the holding pin in a pivotal fashion, said actuating part being foldable from a first position essentially parallel to the attachment flange into a second position essentially parallel to the longitudinal axis of the holding pin.

17. A fitting part having an attachment device for attaching the fitting part to a supporting wall, the attachment device comprising a bushing adapted to be inserted into a pre-drilled hole in the supporting wall and secured thereto, a holding pin mounted in a rotatable manner in the bushing, and which after rotation thereof is adapted to engage the wall of the hole, a head of the holding pin engaged with a top side of an attachment flange, and the head of the holding pin having a slot for engagement by a tool for rotation of the holding pin into an actuating position.

18. The fitting part as claimed in claim 17, wherein when said shank part of the holding pin is, mounted in the bushing, the recesses cooperate with said second side of said attachment flange in forming slot-like guides for the pins, and said limbs comprise a flat surface and said lateral widened parts of said head are provided with corresponding flat surfaces adjacent to an initial portion of said slot-like guides, such that for arresting the disk in a position parallel to the attachment flange, the disk is slidable underneath the flat surface of said head.

19. The fitting part as claimed in claim 18, wherein said recesses of said head open forward said shank of said holding pin.

20. The fitting part as claimed in claim 19, wherein said disk is provided with a notch for engagement with a finger nail.

* * * * *